US009145189B2

(12) United States Patent
Johansson

(10) Patent No.: US 9,145,189 B2
(45) Date of Patent: Sep. 29, 2015

(54) LIFTING ARRANGEMENT FOR THE HANDLING OF FLOATING UNITS AT A BOAT

(75) Inventor: Mikael Johansson, Skellefteå (SE)

(73) Assignee: Fundamentet 1865 AB, Skellefteå (SE)

( * ) Notice: Subject to any disclaimer, the term of this patent is extended or adjusted under 35 U.S.C. 154(b) by 142 days.

(21) Appl. No.: 14/003,220

(22) PCT Filed: Feb. 28, 2012

(86) PCT No.: PCT/SE2012/050219
§ 371 (c)(1),
(2), (4) Date: Nov. 1, 2013

(87) PCT Pub. No.: WO2012/121645
PCT Pub. Date: Sep. 13, 2012

(65) Prior Publication Data

US 2014/0041570 A1 Feb. 13, 2014

(30) Foreign Application Priority Data

Mar. 4, 2011 (SE) ..... 1100153

(51) Int. Cl.
*B63B 35/40* (2006.01)
*B63B 23/32* (2006.01)

(52) U.S. Cl.
CPC ..... *B63B 23/32* (2013.01)

(58) Field of Classification Search
CPC ..... B63B 35/40; B63C 3/12
USPC ..... 114/258, 259, 268–274; 414/137.7, 414/137.8
See application file for complete search history.

(56) References Cited

U.S. PATENT DOCUMENTS

| | | | | |
|---|---|---|---|---|
| 582,069 | A | 5/1897 | Leslie | |
| 3,974,923 | A * | 8/1976 | Mark et al. | 43/8 |
| 5,613,462 | A | 3/1997 | Schwartz | |
| 6,786,170 | B2 * | 9/2004 | Trowbridge | 114/259 |
| 6,955,519 | B1 | 10/2005 | Ferderber | |

(Continued)

FOREIGN PATENT DOCUMENTS

DE 19900240 C1 5/2000

OTHER PUBLICATIONS

International Search Report and Written Opinion received for PCT Patent Application No. PCT/SE2012/050219, mailed on Jun. 21, 2012, 10 pages.

(Continued)

*Primary Examiner* — S. Joseph Morano
*Assistant Examiner* — Andrew Polay
(74) *Attorney, Agent, or Firm* — Morrison & Foerster LLP

(57) ABSTRACT

The invention concern a lifting arrangement, intended for the launch, retrieval and storage of small floating units on a boat, by carrying out at the same time a pivoting and a translational motion in a forwards or in a backwards direction. For easy and safe handling a floating unit at a leisure boat, it comprises a frame (6) intended to be fixed attached to the boat, a link arm system (5) including a lever (10), which through a joint (17) allows pivoting and through the influence of a control and actuator means (13), carry out a tipping action forwards and backwards, an angled lifting arm (12) with a first (12') and a second (12") shank, whereby the lifting arm (12) is guided during the tipping motion through interaction between a guide (20) that protrudes from the frame and a guide surface formed as a cam curve (21) formed from a downwardly facing surface of the lifting arm.

10 Claims, 4 Drawing Sheets

(56) References Cited

U.S. PATENT DOCUMENTS

Figure 1:
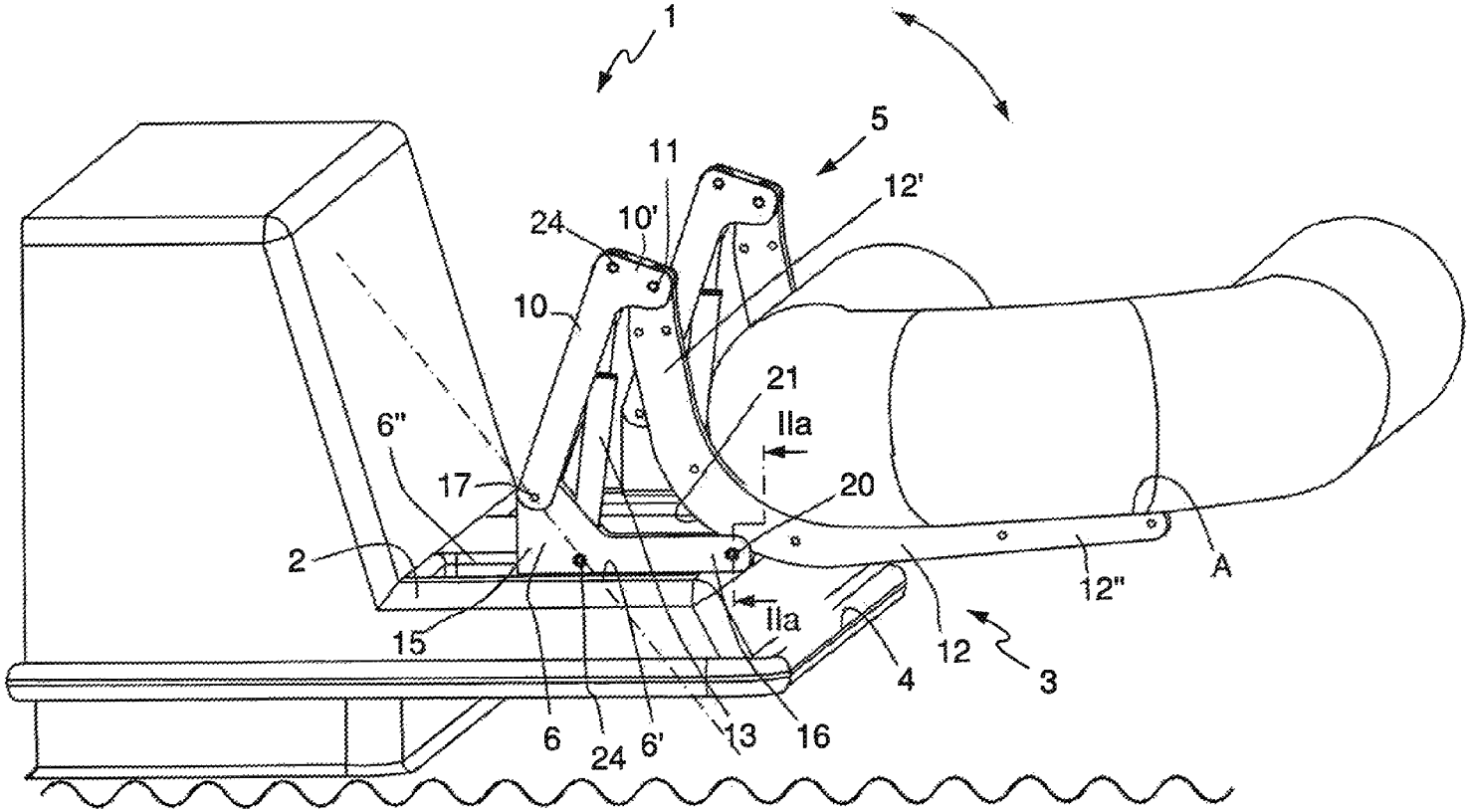

| | | | | |
|---|---|---|---|---|
| 7,293,521 | B1 * | 11/2007 | Johns et al. | 114/259 |
| 8,061,932 | B1 * | 11/2011 | Latham | 405/3 |
| 8,539,896 | B2 * | 9/2013 | Bolline et al. | 114/259 |
| 2001/0039911 | A1 | 11/2001 | Burke | |
| 2010/0122651 | A1 * | 5/2010 | Borum et al. | 114/259 |

OTHER PUBLICATIONS

International Preliminary Report on Patentability received for PCT Patent Application No. PCT/SE2012/050219, mailed on Sep. 19, 2013, 7 pages.

* cited by examiner

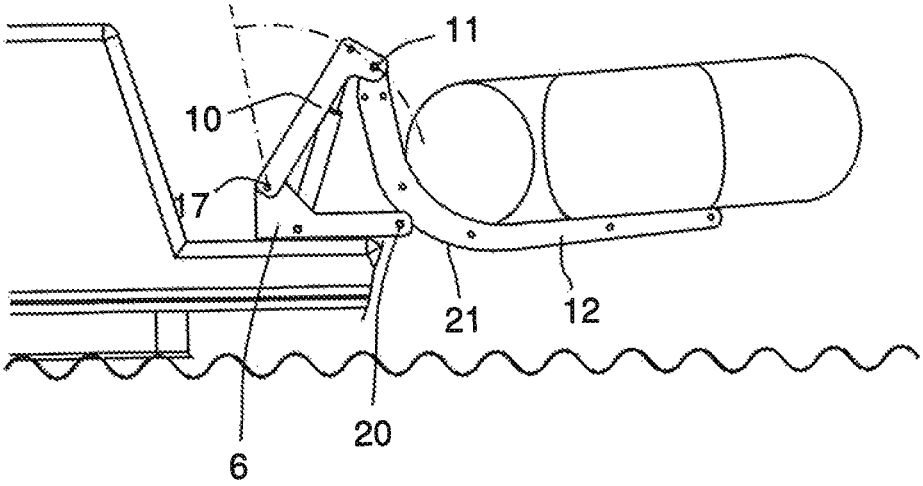
FIG.3c
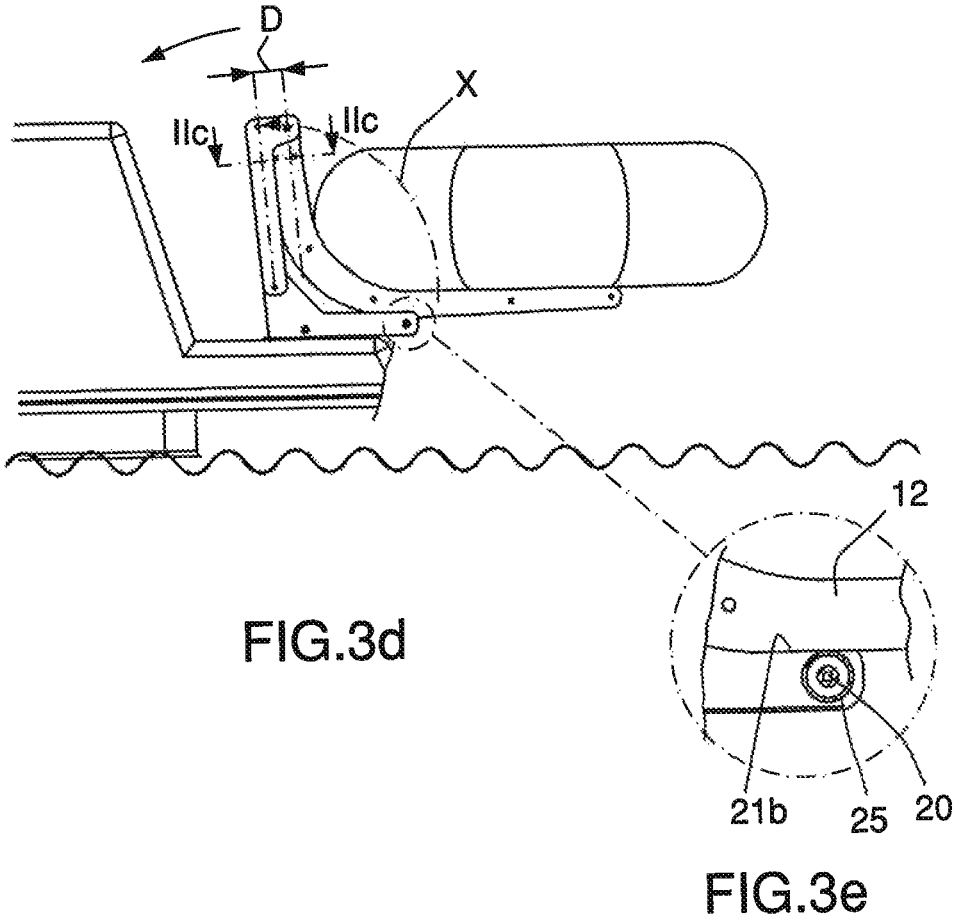
FIG.3d
FIG.3e

LIFTING ARRANGEMENT FOR THE HANDLING OF FLOATING UNITS AT A BOAT

CROSS REFERENCE TO RELATED APPLICATIONS

This application is a U.S. National Phase patent application of PCT/SE2012/050219, filed Feb. 28, 2012, which claims priority to Swedish Patent Application No. 1100153-4, filed Mar. 4, 2011, each of which is hereby incorporated by reference in the present disclosure in its entirety.

The present invention concerns a lifting arrangement for the launching and retrieval of a small floating unit such as a dinghy or water scooter at a boat, according to the introduction to claim 1.

Small boats, in particular leisure boats, are often equipped with some form of davit that is intended to facilitate the retrieval and launch of a small floating unit, such as a dinghy or rubber boat. The term "davit" is here used to denote a lifting arrangement intended for the handling and storage of floating units, suspended along the sides of a boat or at its aft. One known type of davit normally comprises a pair of crane-like arms, with which a floating unit is stowed by being lifted onboard with the aid of lines anchored at the bow and aft of the floating unit. It has become evermore common in recent times to equip leisure boats with water scooters, which are used when the boat is moored at a jetty or anchored. Water scooters, however, are troublesome to handle at a leisure boat due to their relatively large weight, which can in certain cases approach 500 kg. Due to the considerable weight of the water scooter, it is not appropriate, either, to handle and stow the water scooter freely suspended in lines from davits during retrieval and launch. It must be possible to handle a water scooter in a stable and safe manner such that it moves free from the railing when it is being retrieved or launched. It is, of course, a requirement that the lifting arrangement must be able to pivot the water scooter during lifting so far out from the side of the boat that damage to the rail and hull is avoided. Any contact with the railing that takes place may cause serious damage not only to the floating unit but also to the railing of the boat.

It would be desirable for the handling of heavy floating units such as water scooters at leisure boats to have a lifting arrangement that demonstrates a robust and compact design so that it does not occupy too large a space of the normally relatively limited space on a leisure boat. Furthermore, a lifting arrangement is aspired to that demonstrates a high displacement capacity not only in the horizontal direction but also in the vertical direction, and that is so designed that it can lift and manage relatively heavy objects, not least a water scooter, without requiring any appreciable force. Furthermore, it is desirable that heavy floating units can be stowed and stored in a safe manner at a leisure boat, such that they are secure also in significantly heavy seas.

The purpose of the present invention, therefore, is to achieve a lifting arrangement that makes it possible to handle in a simple and safe manner a floating unit at a leisure boat, and in particular a heavy floating unit such as a water scooter.

This purpose of the invention is achieved through a lifting arrangement demonstrating the features and characteristics that are specified in claim 1. Other distinctive features and advantages of the invention are made clear by the non-independent claims.

Figure 2A:
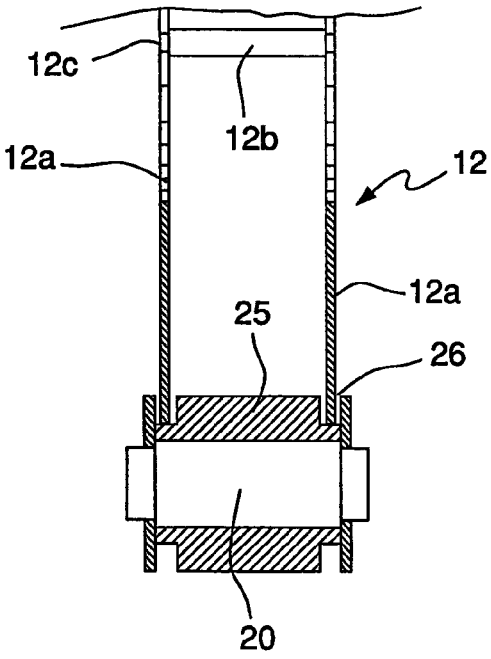
Figure 2C:
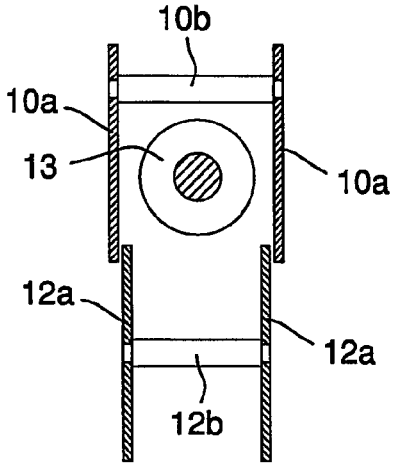
Figure 2D:
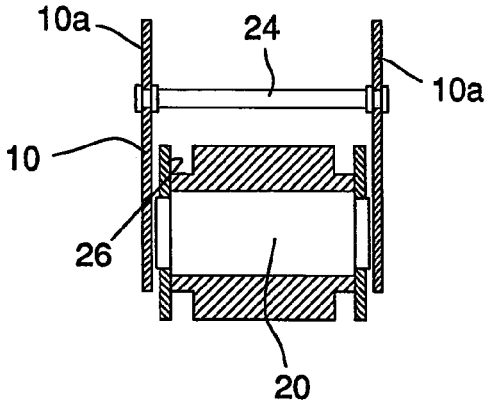
Figure 2B:
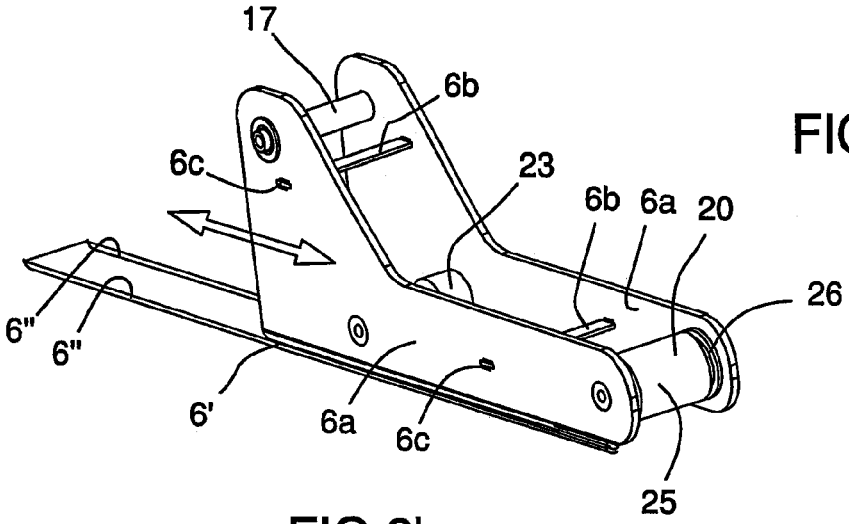
Figure 3A:
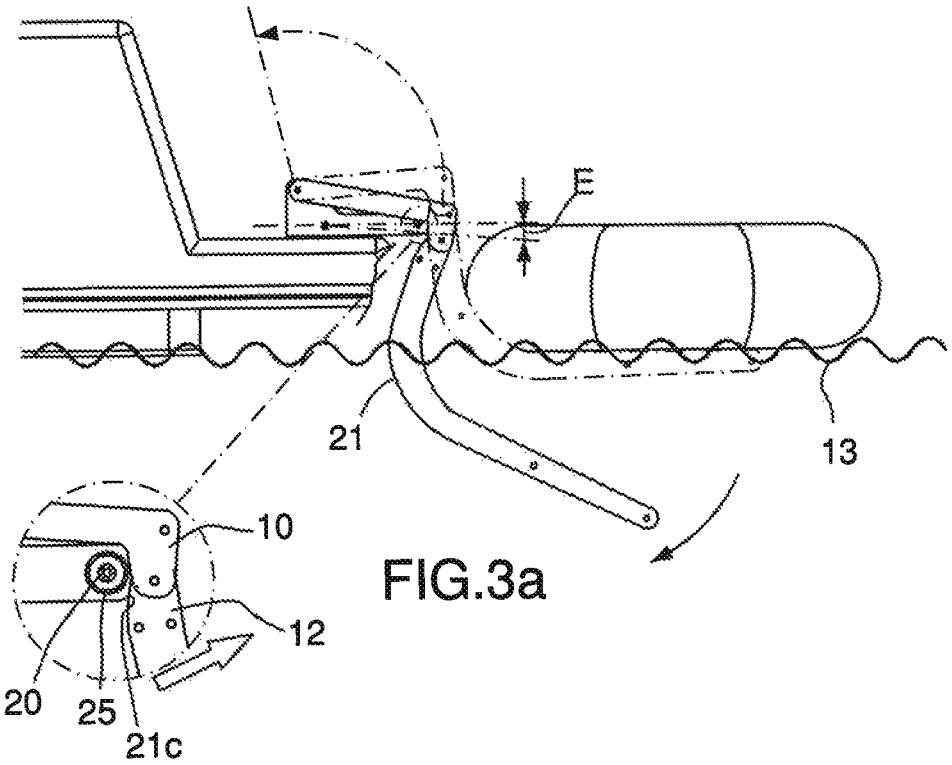

The invention will be described below in more detail under the guidance of an embodiment and with reference to the attached drawings, of which:

FIG. 1 shows a perspective view of a part of the aft of a boat with an extended aft deck known as a "bathing platform", on which a lifting arrangement according to the present invention is mounted, FIG. 2*a* shows a cross-sectional view with certain parts removed of a lifting arm that is a component of the lifting arrangement, and supporting guides, viewed along the line IIa-IIa in FIG. 3*d*, FIG. 2*b* shows a perspective view of a frame that is a component of the lifting arrangement intended to be mounted on an essentially plane horizontal surface of the boat, appropriately a bathing platform, FIG. 2*c* shows a cross-sectional view through a lever that is a component of the lifting arrangement, and a lifting arm that interacts with this lever, viewed along the line IIc-IIc in FIG. 1, FIGS. 3*a*-3*d* show the working method of the lifting arrangement during retrieval of a floating unit in a series of views from a lowered position in the water to an upper storage condition in which the floating unit is stowed on the boat, and FIG. 3*e* shows a detailed enlargement of a ringed region in FIG. 3*d*, showing the interaction between the lower surface of the lifting arm that is a component of the lifting arrangement and the protruding supporting roller of the frame when the lifting arrangement has been placed into its withdrawn condition.

FIG. 1 shows schematically a perspective view of the aft 1 of a boat, in particular what is known as a "leisure boat", with an extended aft deck 2 known as a "bathing platform", on which a lifting arrangement 3 according to the present invention is mounted. Two identical lifting arrangements acting in a pair are, of course, used for the launch or retrieval of a small floating unit. Only one of these lifting arrangements will, for reasons of simplicity, be described in more detail below. The reference number 4 denotes the rail of the boat, or its surrounding fender rail. The lifting arrangement 3 includes a lifting arm system 5 consisting of arm sections united to allow pivoting. The lifting arm system 5 is supported by a frame 6, which is, in turn, fixed attached to the bathing platform 2 of the boat. The said frame 6 is intended to be fixed attached with, for example, penetrating bolts onto the bathing platform 2. The frame 6 has a lower base 6' that forms a part of a guide comprising a profile section 6" with two parallel penetrating extended holes that allow the frame, and thus the complete lifting arm system 5, to be displaced backwards as a unit on the bathing platform 2, as is shown by the double arrow in FIG. 2*b*, and thereafter to be fixed at a freely chosen position along the length of the profile.

The arm system 5 of the lifting arrangement 3 includes a lever 10 that transitions at its free end into a perpendicular part 10' directed to the side, which perpendicular part is mounted by a peg 11 to allow pivoting with an essentially right-angled or L-shaped lifting arm 12. Through the jointed connection 11 between the lever 10 and the lifting arm 12 being located at the sideways-directed part 10', it will also be displaced to the side by a distance D relative to the longitudinal axis of the lever 10, which sideways displacement facilitates that the arm link system during stowing can take up the folded and compact position shown in FIG. 3*d*. The angled lifting arm 12 demonstrates first 12' and second 12" shanks with different lengths, and it is jointed to pivot through its first, relatively short shank 12' to the free end 11 of the lever 10, while the relatively long second shank 12" is directed out from the rail 4 of the boat. A piston and cylinder unit 13 is arranged between the lever 10 and the frame 6 for pivoting the lever in a vertical plane that is parallel with the longitudinal direction of the boat, and thereby for imparting to the complete arm system 10, 12 the motion required for operation. When the piston and cylinder unit 13 is extended, the lever 10 pivots from the lowered position shown in FIG. 3*a* in which a load-bearing part A formed by the two lifting arms is located at a position under the water surface is the piston and cylinder unit], to the raised upper storage or stowage position onboard the boat shown in FIG. 3*d*. The two levers 10 of the lifting arrangement 3 that act as a pair work synchronously and together with the associated lifting arms 12 form a forked parallel displaceable load-bearing part A. Operation of the present lifting arrangement 3 can take place in any suitable manner at all, for example, manually, or wireless through remote control using radio control.

With reference to FIGS. 2*a*-2*d*, the units that are components of the lifting arm system 5 are manufactured as light-weight constructions of preferably laser-cut plane sheet elements in the form of pieces of sheet metal that, in order to form side pieces of the arm sections 10, 12 that are components of the lifting arm system 5 or the frame 6, include parallel sheet elements 10*a*, 12*a*, 6*a*, located at a mutual distance from each other and joined by means of transverse spacer elements 10*b*, 12*b* 6*b*, also these manufactured from sheet metal. The sheet metal elements for the mounting and joining are formed with rectangular pegs and holes 10*c*, 12*c*, 6*c*, which can be compared in function with dowels and dowel holes of wooden constructions, and which are able to hold together the united plates as self-operating jigs during subsequent welding, whereby, as FIG. 2*b* makes most clear, two parallel side pieces 6*a* are joined by a welded joint in association with the said peg and hole 6*c*. Also circular pegs 11, 17 extend between the parallel sheet metal elements, which pegs have, in essentially the same manner as the spacer elements described above, the task of not only supporting the parallel side pieces at a mutual separation but also of forming joints for the connection between arm sections that are jointed in a manner that allows pivoting and connection points for the piston and cylinder unit 13 that operates between the arm sections. According to the invention, the arm sections 10, 12 that are formed from sheet metal elements 10*a*, 12*a*, 6 joined in a parallel manner, and the frame 6, are so dimensioned that the opposing shank parts (the side elements) of the frame parts mounted to pivot in bearings overlap each other at the joints (the shank parts of one frame part thus overlap the shank parts of the second frame part), whereby such a degree of mutual ability to pivot is obtained that the longitudinal axes of the arm sections can intersect each other, as should be realised if FIG. 3*a* and the associated enlargement are studied in more detail. See also FIG. 3*d*.

Once again with reference to FIG. 1, the frame 6 that is a component of the lifting arrangement 3 demonstrates a rear 15 and a forward 16 end, whereby the lever 10 is joined at its lower end through a peg 17 with the rear end of the frame, for pivoting in the said vertical plane. Further, the frame 6 is so adapted and mounted on the bathing platform 2 that its front end 16 forms a guide 20 that protrudes from the bathing platform 2 or from the railing 4, on which a guide surface formed as a principally convex cam curve 21 of the lower side 21 of the lifting arm and that has the form of the arc of a circle can move in order to achieve positioning of the lifting arm 12 during the tipping motion of the lever 10. The tipping action forwards and backwards in the vertical plane is indicated by the arrow on the top right in FIG. 1.

Figure 3B:
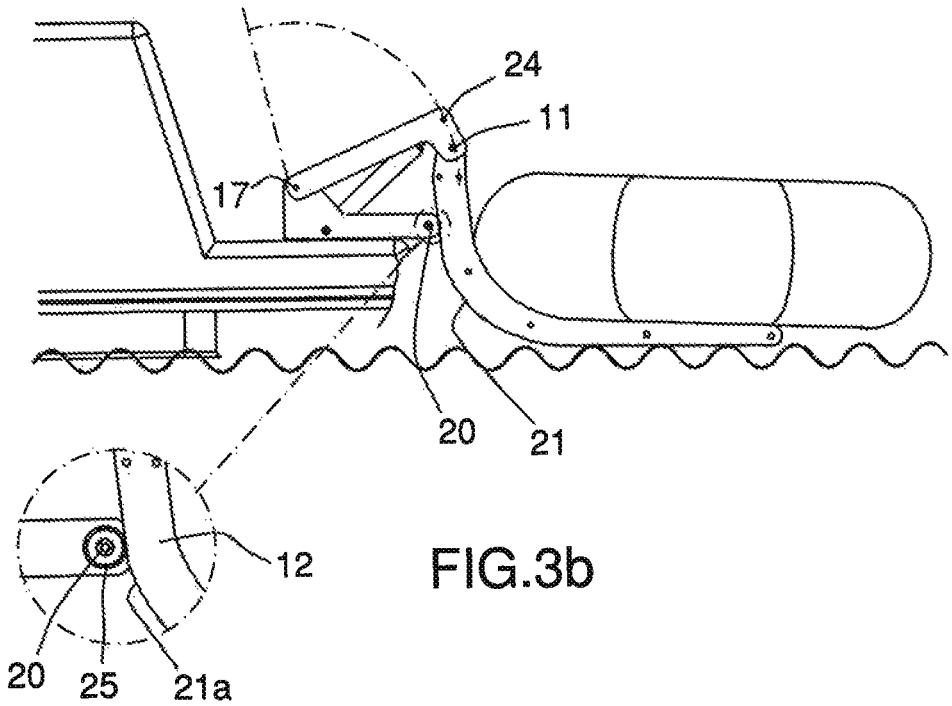

As FIG. 3*a* makes most clear, the lever 10 can be tipped forwards and backwards in the said vertical plane under the influence of the double-action piston and cylinder unit 13, which operates through a first 23 and a second 24 peg between the frame 6 and the free end of the lever 10. The solid arrow on the bottom right in FIG. 3*a* indicates the terminal part of the forwards tipping motion of the lever 10. In other words, the lever 10 rests at the terminal position of the forward tipping motion. See also FIG. 3*b*. Thus, on activation of the piston and cylinder unit 13, the lever 10 pivots around the peg, whereby the lifting arm 12 moves upwards or downwards under interaction of the protruding guide 20 of the frame. In that the lifting arm 12 is guided in a supportive manner along a transport distance 21*a* having essentially the form of an arc of a circle of the cam curve 21 against the guide 20, it is ensured that a floating unit supported by one of the longer shanks 12" of the lifting arms will move under parallel motion upwards and downwards at the railing 4 along a pathway in which the lifting arm 12 and the floating unit are located at a definite distance from the railing 4 of the boat. The desired tilt and motion for the load-bearing part A formed from the longer shank 12" of the lifting arm 12 such that it is located horizontally during its parallel motion and during essentially the complete lifting operation above the surface 13 of the water, as shown in FIGS. 3*b*-3*d* and at its various heights, is obtained through suitable dimensioning of selected joints of the parts that are mounted to pivot, the cam curve 21 of the lifting arm 12 at the transport distance, and the guide 20. It is appropriate that selected joints and interacting parts are given such designs that the load-bearing part A formed by the lifting arm 12 is tipped somewhat inwards towards the boat during the lifting operation, in order to ensure that there is no risk that the floating unit supported by the load-bearing part slides off.

The frame 6 is shown in more detail in FIGS. 2*a* and 2*b* and, as these make clear, the protruding part of the frame that forms the guide 20 is provided with a friction-reducing support roller 25, with which the lower side of the lifting arm 12 that has the form of a cam curve 21 interacts. With reference to FIG. 2*a* in particular, it is clear that the lifting arm 12 is guided along tracks during rolling off in a sideways direction from the support roller 25 to the frame 6, i.e. in the transverse direction of the boat, through the rolling section including a guide track 26, in which guide track the two lower side edges 21 of the sheet metal side pieces 12*a* of the lifting arm 12 that are arranged parallel in pairs run.

A cross-section through the lever 10 is shown in FIG. 2*c*, and as the drawing makes clear, the distance between the two pair-wise sheet metal side pieces 10*a* that are placed parallel to each other is so adapted that the piston and cylinder unit 13 can be located within the compartment that is limited by the sheets of metal. This is particularly advantageous when the lever 10 is located placed at its outermost positions, i.e. in its essentially backwards tipped position as is shown in FIG. 3*d*, and in its fully downwards tipped position as is shown in FIG. 3*a*.

The lifting arrangement 3 is shown in FIG. 3*d* placed in its withdrawn upper inactive position, with a floating unit resting on the longer protruding shank 12" of the lifting arm 12. As careful study of the drawing will make clear, the lever 10 has in this withdrawn position been moved backwards into a self-locking position somewhat above the centre, i.e. in a backwards tilted angular position that is greater than 90° relative to the horizontal plane, which angular position is specified by the arrow X in FIG. 3*d*. In other words, the lifting arm 12 is maximally tipped backwards, as indicated by the arrow on the top left in FIG. 3*d*. Taking up this position is significantly facilitated from a purely constructional point of view through it being possible to place the piston and cylinder unit 13 in the intermediate space of the lever 10. As the enlargement of detail in FIG. 3*e* makes clear, in this withdrawn self-locking position a linearly inactive section 21*b* of the cam curve 21 that lies essentially in the horizontal plane interacts with the guide roller 25, and this means that the arm link system 10, 12 of the lifting arrangement 3 is, in principle, free of load from the weight of the floating unit. Thus, the lifting arm system 10, 12 can be taken out from this self-locking position by the influence of the external force that arises through activation of the piston and cylinder unit 13. The pattern of motion for the lifting arm 12 that is a component of the lifting arrangement 3 is shown in FIG. 3*a* at various lifting angles, whereby it is made clear that the lifting arm executes a combination of pivoting and translation motion, while the transport distance of the cam curve 21 interacts with the support roller 25, i.e. a motion in the sideways direction and the vertical direction is carried out during launch and retrieval of small floating units.

With reference to FIG. 3*a* and the associated enlargement, it is shown in more detail how the present lifting arrangement, despite its compact design, makes possible the lift of heavy floating units with relatively large draft, through it allowing the lifting arm 12 to take up a position that is downwardly angled by the angle E from the horizontal plane when it is close to the surface 13 of the water, or under it. This downwardly angled position is achieved through the jointed coupling between the sideways directed part 10' of the lever 10 and the lifting arm 12 allowing the lever 10 to be lowered into a superior position, i.e. so far forwards that the contact between the support roller 25 and the cam curve 21 of the lifting arm transitions into a section 21*c* that is free of turning moment. This is a region in which the support roller 25 essentially stops its interaction with the cam curve 21 such that the lifting arm is allowed to fall freely under its own weight down to the position that is shown in FIG. 3*a*.

According to the invention, this position is achieved through a combination of a number of measures: Firstly, through the cam curve 21 at the section 21*c* that is without turning moment transitioning into a radially withdrawn part in close connection with the joint; secondly, through the joint 11 between the lever 10 and the lifting arm 12 being sideways displaced by a distance D relative to the longitudinal axis of the lever, which allows the joint to move further downwards and to a horizontal plane that intersects the support roller 25; and thirdly, through it being possible to fold together the two parts 10, 12 that are joined at the joint 11 in a manner that allows pivoting in a overlapping manner over each other such that a line the exits from the centre of rotation 17 of the lever 10 and extending through the joint 11 form a negative angle E with the horizontal plane.

With reference to FIGS. 3*a* and 3*d*, the arrangement functions in the following manner:

From a lowered initial position that is shown in FIG. 3*a* in which the relatively longer shank 12" of the lifting arm 12 is located under the surface 13 of the water and in a position that is downwardly angled and free of turning moment, a floating unit, in this case a rubber dinghy, is drawn in over the shank 12" and fastened by a line or rope to it. The sideways directed part 10' of the lever is located by this in a downwardly angled position and overlaps the protruding support roller 25 of the frame 6, which contributes significantly to the longer shank 12" of the lifting arm 12 being positioned in a downwardly angled position and at a level considerably under the surface 13 of the water. The piston and cylinder unit 13 is subsequently activated such that the lever 10 moves backwards and upwards from its principally horizontal position as is shown in the stages in FIGS. 3*b* and 3*c*. When the lever 10 has reached its self-locking backwardly tilted position X, i.e. a position at an angle that is greater than 90°, the linearly inactive section 21' of the cam curve 21 is at the same time resting against the support roller 25, whereby the lifting arrangement 3 is locked in its upper storage position.

The invention is not limited to what has been described above and shown in the drawings: it can be changed and modified in several different ways within the scope of the innovative concept defined by the attached patent claims.

The invention claimed is:

1. A lifting arrangement, for launch, retrieval and storage of small floating units on a boat, by carrying out at the same time a pivoting and a translational motion from a railing of the boat when seen in a forwards or in a backwards direction down towards a water surface that surrounds the boat, wherein the lifting arrangement includes lifting arrangement units that act in pairs, each lifting arrangement unit comprising:

a frame to be attached to the boat, a link arm system supported by the frame and including a lever, one end of which is united with the frame through a first joint in a manner that allows pivoting and arranged to, through the influence of an actuator, carry out a tipping action forwards and backwards in a vertical plane, an angled lifting arm with a first and a second shank where the first shank is united in a manner that allows pivoting though a second joint with a second end of the lever and where the second shank forms a load-bearing part for the floating unit, whereby the lifting arm is guided during a tipping motion through interaction between a guide that protrudes from the frame and a guide surface formed as a cam curve formed from a downwardly facing surface of the lifting arm.

2. The lifting arrangement according to claim 1, whereby the cam curve comprises a curved transport section that is so designed relative to the guide that the lifting arm executes a parallel motion during a backwards tipping motion of the lever, relative to the railing, in which the load-bearing part of the second shank is horizontally oriented during the tipping motion, or arranged to be oriented in a somewhat upwardly angled position in order to retain the floating unit.

3. The lifting arrangement according to claim 1, whereby the cam curve in an upper part of the lifting arm transitions into a section, where the cam curve is radially withdrawn so that the guide during a terminal part of the forwards tipping motion of the lever ceases to support against the cam curve, as a consequence of which the second shank of the lifting arm is allowed to fall under its own weight and take up a position that is downwardly angled relative to a horizontal plane.

4. The lifting arrangement according to claim 1, whereby the protruding guide comprises a support roller that can be rotated around an axis, while the cam curve is formed as a section of the downwardly facing side of the lifting arm that can be rolled against the support roller.

5. The lifting arrangement according to claim 1, whereby, when the lifting arm is maximally tipped backwards, a self-locking inactive position is achieved in which an essentially linear inactive section of the cam curve in a horizontal plane is located in a rest position in interaction with the protruding guide.

6. The lifting arrangement according to claim 1, whereby the lever at the end that is facing away from the frame transitions into a sideways facing section in which the first shank of the lifting arm is so united through a peg in a manner that allows pivoting that the second joint that is formed in this manner, at the maximally forwardly tipped position of the lever, is located below a horizontal plane that intersects the guide.

7. The lifting arrangement according to claim 1, whereby the frame has a lower base to be mounted on a bathing platform of a boat and which base forms part of a guide that allows the frame, and thus the complete link arm system, to be displaced backwards as a unit on the bathing platform.

8. The lifting arrangement according to claim 1, whereby at least one of the lever, the lifting arm and the frame are manufactured from sheet elements placed parallel at a certain separation from each other, which elements are joined by transverse spacer elements which also are manufactured from sheet metal, where the said parts are united to each other by means of welding.

9. The lifting arrangement according to claim 8, whereby the second joint between the lever of the lifting arm and the first joint between the frame and the lever demonstrates sheet elements whose separation from each other is so selected that adjacent ends overlap each other at the first and second joints.

10. The lifting arrangement according to claim 8, whereby a rolling section between the cam curve and a support roller includes a guide track, in which guide track the two lower sheet metal side edges of the side pieces of the lifting arm that are placed in pairs run.

* * * * *